US007611263B2

(12) United States Patent
Huang et al.

(10) Patent No.: US 7,611,263 B2
(45) Date of Patent: Nov. 3, 2009

(54) LIGHT SOURCE MODULE WITH A THERMOELECTRIC COOLER

(75) Inventors: Chung-Yuan Huang, Santa Clara, CA (US); Jer-Haur Kuo, Taipei Hsien (TW); Shun-Yuan Jan, Taipei Hsien (TW); Ye-Fei Yu, Shenzhen (CN); Xin-Xiang Zha, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/107,780

(22) Filed: Apr. 23, 2008

(65) Prior Publication Data

US 2009/0168429 A1 Jul. 2, 2009

(30) Foreign Application Priority Data

Dec. 27, 2007 (CN) ..... 200710186116

(51) Int. Cl.
*F21V 33/00* (2006.01)

(52) U.S. Cl. ..... 362/249.02; 362/800; 362/294

(58) Field of Classification Search ..... 362/800, 362/249.01, 294, 249.02
See application file for complete search history.

(56) References Cited

U.S. PATENT DOCUMENTS

| | | | | |
|---|---|---|---|---|
| 6,517,218 | B2 | 2/2003 | Hochstein | |
| 7,075,112 | B2 * | 7/2006 | Roberts et al. | 257/79 |
| 7,208,881 | B2 * | 4/2007 | Young | 315/224 |
| 2004/0120156 | A1 * | 6/2004 | Ryan | 362/373 |

* cited by examiner

*Primary Examiner*—Laura Tso
(74) *Attorney, Agent, or Firm*—Frank R. Niranjan

(57) ABSTRACT

A light source module (100) includes a plurality of light emitting diodes (13), a heat dissipation device (30) and a thermoelectric cooler (20). The thermoelectric cooler has a cold side (21) and a hot side (23). The light emitting diodes are in thermal engagement with the cold side of the thermoelectric cooler. The heat dissipation device is in thermal engagement with the hot side of the thermoelectric cooler.

9 Claims, 4 Drawing Sheets

LIGHT SOURCE MODULE WITH A THERMOELECTRIC COOLER

BACKGROUND OF THE INVENTION

1. Field of the Invention

The present invention relates to a light source module, and particularly to a light source module having a thermoelectric cooler which can enhance heat dissipation efficiency of the light source module.

2. Description of Related Art

With the continuing development of scientific technology and the raise of people's consciousness of energy saving, light emitting diodes (LEDs) have been widely used in the field of illumination due to their small size and high efficiency. It is well known that a light source module using LEDs arranged side-by-side in a large density generates a lot of heat when it emits light. If the heat cannot be quickly removed, the light source module may become overheated, significantly reducing work efficiency and service life thereof.

A conventional heat sink which is used to absorb heat of the LED device is shown in U.S. Pat. No. 6,517,218. The heat of the LED device is transferred to a base of a heat dissipater at first, and then is dissipated to ambient air in a natural convection manner by fins of the heat dissipater. However, with increasing of power of the light source module, it is insufficient to only use the heat dissipater with fin to dissipate the heat generated by the light source module.

What is needed, therefore, is a light source module with LEDs. Heat generated by the LEDs can be effectively dissipated so that the LEDs can work normally for a sufficiently long period of time.

SUMMARY OF THE INVENTION

A light source module includes a plurality of light emitting diodes, a heat dissipation device and a thermoelectric cooler. The thermoelectric cooler has a cold side and a hot side. The light emitting diodes are in thermal engagement with the cold side of the thermoelectric cooler. The heat dissipation device is in thermal engagement with the hot side of the thermoelectric cooler.

Other advantages and novel features of the present light source module will become more apparent from the following detailed description when taken in conjunction with the accompanying drawings.

BRIEF DESCRIPTION OF THE DRAWINGS

Many aspects of the present light source module can be better understood with reference to the following drawings. The components in the drawings are not necessarily drawn to scale, the emphasis instead being placed upon clearly illustrating the principles of the present light source module. Moreover, in the drawings, like reference numerals designate corresponding parts throughout the several views.

DETAILED DESCRIPTION OF THE INVENTION

Figure 1:
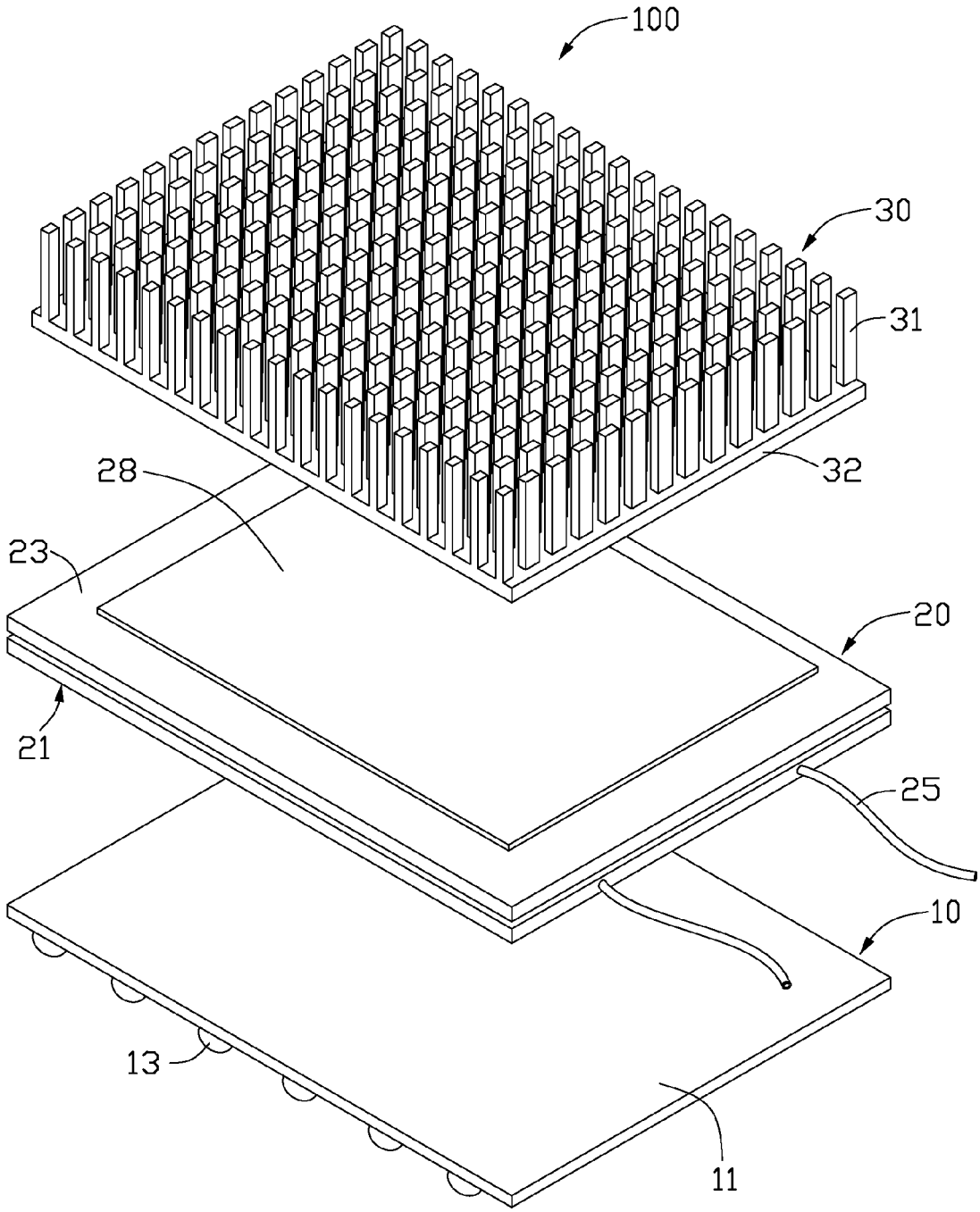
FIG. 1 is an explored, isometric view of a light source module in accordance with a first embodiment of the present invention.
Figure 2:
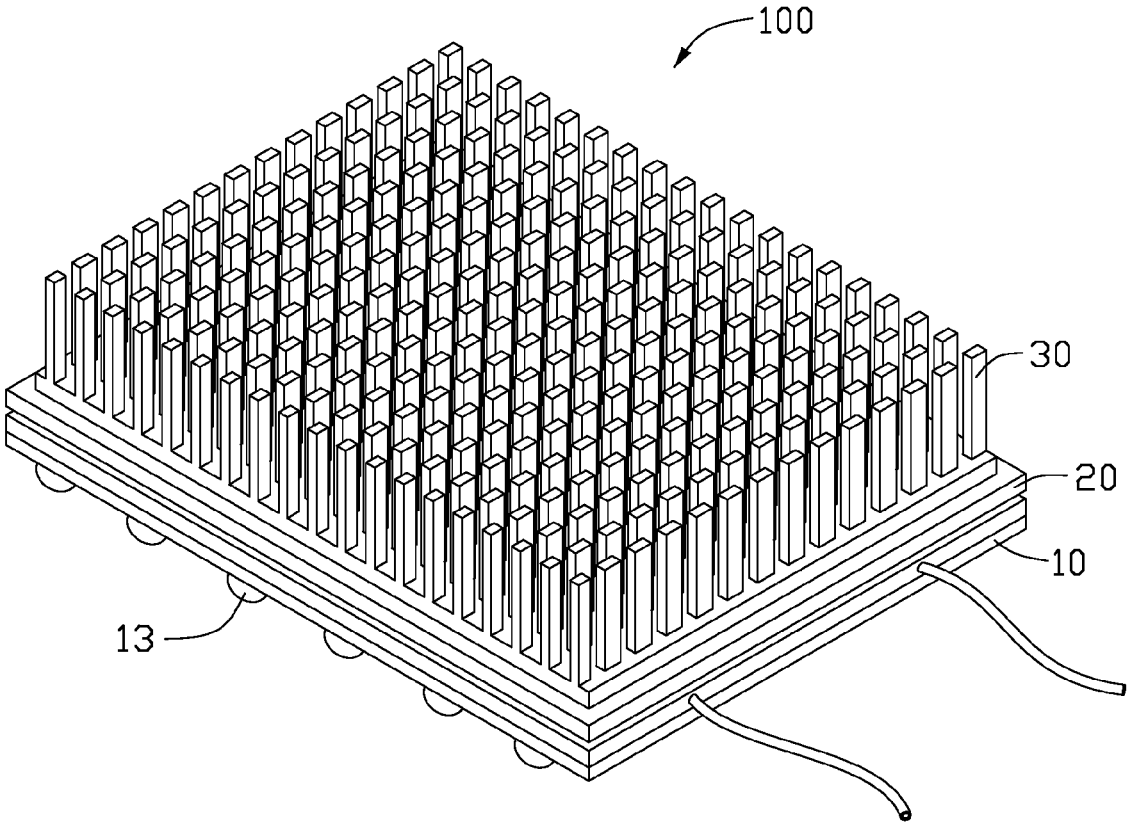
FIG. 2 is an assembled, isometric view of the light source module shown in FIG. 1.

Referring to FIG. 1, a light source module 100, in accordance with a present embodiment of the invention, comprises an LED module 10, a thermoelectric cooler 20 and a heat dissipation device 30. The heat dissipation device 30 is disposed on an upside of the thermoelectric cooler 20. The LED module 10 is attached at a downside of the thermoelectric cooler 20. In other words, the thermoelectric cooler 20 is sandwiched between the LED module 10 and the heat dissipation device 30, and serves to transfer heat from the LED module 10 to the heat dissipation device 30.

The LED module 10 comprises a printed circuit board 11 and a plurality of LEDs 13 electrically mounted on the printed circuit board 11. The LEDs 13 can be white LEDs or multicolor LEDs such as red, green and blue LEDs. The LEDs 13 are mounted on the printed circuit board 11, through which the LEDs 13 thermally contact with the thermoelectric cooler 20. The printed circuit board 11 can be attached to a bottom surface of the thermoelectric cooler 20 by means of adhesive or fasteners.

The thermoelectric cooler 20 comprises a cold side 21 and a hot side 23 opposite the cold side 21. The LED module 10 thermally contacts with the cold side 21 of the thermoelectric cooler 20, and the heat dissipation device 30 thermally contacts with the hot side 23 of the thermoelectric cooler 20. Electrical wires 25 are connected to the thermoelectric cooler 20 for providing a direct current (DC) to the thermoelectric cooler 20.

In operation, the cold side 21 can be driven by the DC to absorb heat from the LEDs 13 and the hot side 23 can be driven to dissipate the heat to the heat dissipation device 30. Thus, the heat generated by the LED module 10 can be upwardly transmitted through the thermoelectric cooler 20 to the heat dissipation device 30. An outer surface of the thermoelectric cooler 20 is made of insulative material that has a low heat conductivity. Thus, the outer surface of the hot side 23 is covered with a layer 28, which is made of a heat conductive material and has high heat conductive coefficient, such as metal or thermal grease. The layer 28 is sandwiched between the hot side 23 and the heat dissipation device 30 for enhancing heat transfer efficiency between the thermoelectric cooler 20 and the heat dissipation device 30.

The heat dissipation device 30 comprises a base 32 and a plurality of fins 31 extending upwardly from the base 32. A bottom surface of the base 32 has a similar shape and size to a top surface of the hot side 23. The base 32 is coupled on the layer 28, and thermally contacts with the hot side 23 of the thermoelectric cooler 20 through the layer 28.

Heat is generated from the LED module 10 during illumination. When a temperature of the light source module 20 rises beyond the normal temperature range, the thermoelectric cooler 20 is powered by the DC to work. The heat generated by the LEDs 13 is absorbed by the thermoelectric cooler 20 in an electric energy manner and then forcedly transferred to the hot side 23 from the cold side 21 of the thermoelectric cooler 20. The heat accumulated on the hot side 23 of the thermoelectric cooler 20 is immediately transferred to the base 32 to be dissipated into surrounding air via the fins 31 of the heat dissipation device 30.

The heat flux from the LEDs 13 to the cold side 21 of the thermoelectric cooler 20, and the heat flux from the hot side 23 of the thermoelectric cooler 20 to the fins 31 of the heat dissipation device 30 are respectively more than the heat flux from the LEDs 13 directly transferred to the fins 31 when the thermoelectric cooler 20 is not mounted between the LED module 10 and the heat dissipation device 30. Thus, by the provision of the thermoelectric cooler 20 mounted between the LED module 10 and the heat dissipation device 30, the efficiency of the heat dissipation of the LEDs 13 can be enhanced. By means of controlling the DC, the light source module 20 can be ensured to operate at a normal temperature range so as to achieve a better optical performance. Temperature difference between the cold side 21 and the hot side 23 can be controlled in an approximate range between 70° C. and 80° C. It is to be understood that contact areas between the base 32 and the hot side 23 should be as large as possible to enhance the heat dissipation efficiency of the light source module 100.

Figure 3:
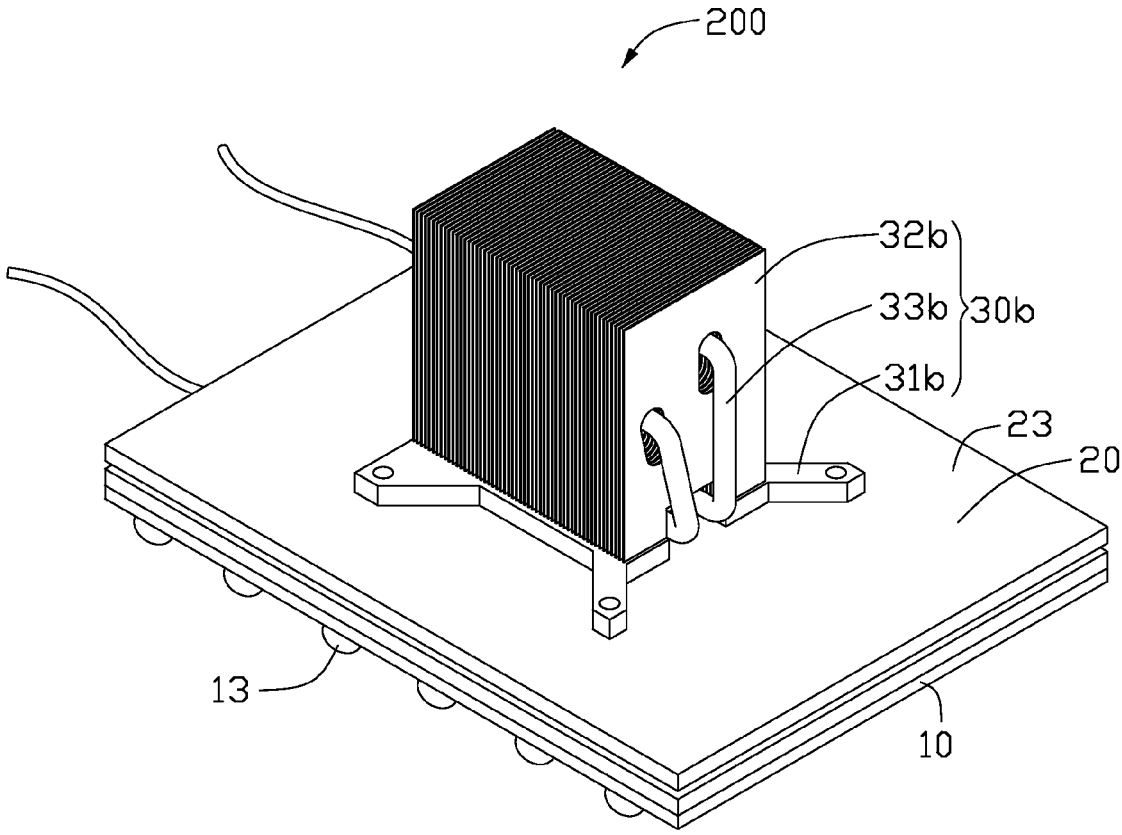
FIG. 3 is an assembled, isometric view of a light source module in accordance with a second embodiment of the present invention.

Referring to FIG. 3, a light source module 200 in accordance with a second embodiment of the present invention is provided. Compared with the first embodiment, the light source module 200 comprises a heat dissipation device 30*b* instead of the heat dissipation device 30. The heat dissipation device 30*b* comprises a base 31*b*, a plurality of fins 32*b* and two heat pipes 33*b*. The base 31*b* contacts with the thermoelectric cooler 20. The fins 32*b* are soldered to a top surface of the base 31*b*. One end of each of the heat pipes 33*b* is attached to the top surface of the base 31*b* or the hot side 23 of the thermoelectric cooler 20 and another end of each of the heat pipes 33*b* is thermally coupled to the fins 32*b*. Thus, the heat accumulated at the hot side 23 of the thermoelectric cooler 20 can be removed away more quickly.

Figure 4:
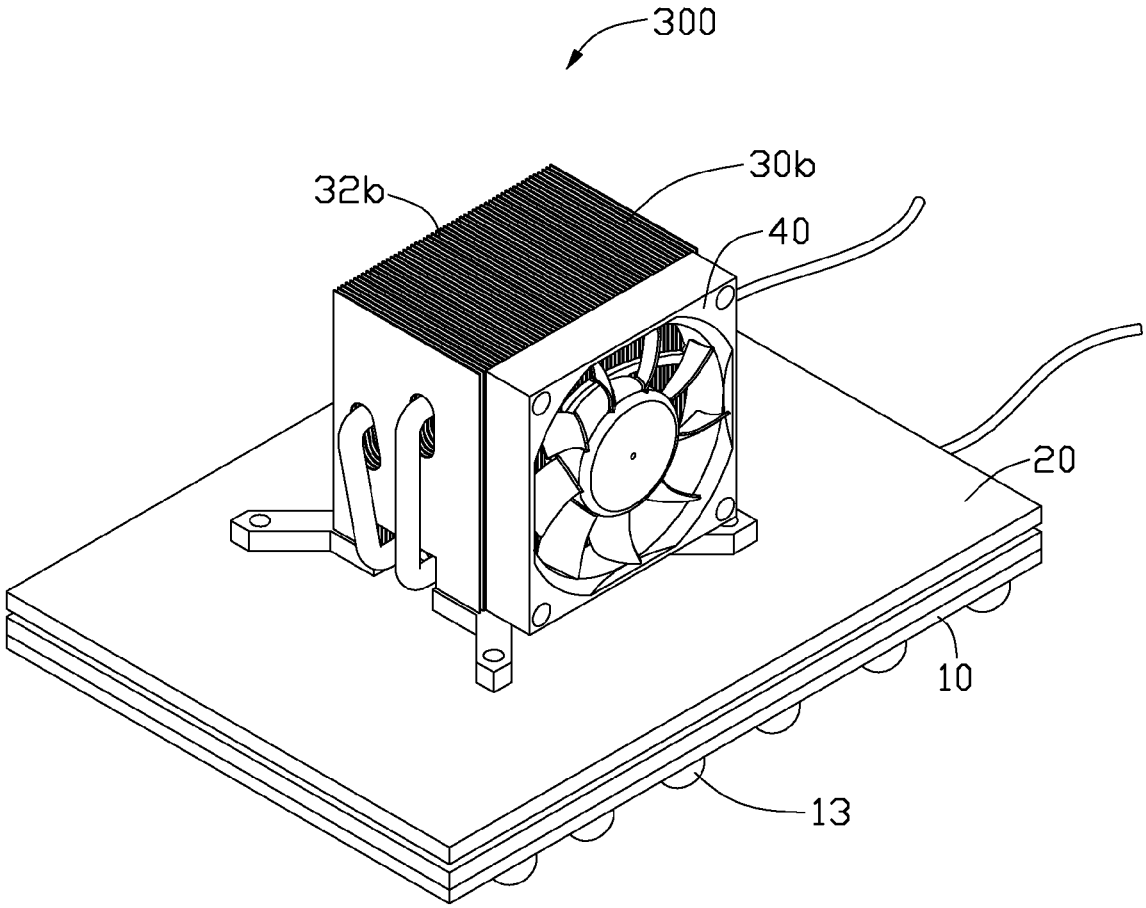
FIG. 4 is an assembled, isometric view of a light source module, in accordance with a third embodiment of the present invention.

FIG. 4 show a third embodiment of a light source module 300 according to the present invention. Compared with the second embodiment, the light source module 300 further comprises a fan 40. The fan 40 is attached to a lateral side of the heat dissipation device 30*b* for providing forced airflow. An outlet opening of the fan 40 is positioned facing channels between the fins 32*b* of the heat dissipation device 30*b*. The forced airflow generated by the fan 40 is driven to flow through the fins 32*b* so that heat of the heat dissipation device 30*b* can be dissipated more quickly.

It is to be understood that a fan can also be secured to a top of the fins 31 of the heat dissipation device 30 in the first embodiment. A heat dissipation device comprising heat pipe and fins, but no base, can be used to replace the heat dissipation device 30*b* of the second embodiment. One end of the heat pipe can be directly configured to be in thermal engagement with the LEDs. A vapor chamber or a flat heat pipe can also be used to be secured on the hot side 23 of the thermoelectric cooler 20 to enhance heat dissipation efficiency.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A light source module, comprising:

an LED module comprising a plurality of LEDs;

a heat dissipation device comprising a base, a plurality of fins located on a top surface of the base and a fan arranged at a lateral side of the fins for generating an airflow, an outlet opening of the fan being positioned facing channels between the fins whereby the air flow generated by the fan is driven to flow through the fins;

a thermoelectric cooler having a cold side and a hot side, the cold side being in thermal engagement with the light emitting diodes, and the hot side being in thermal engagement with a bottom surface of the base of the heat dissipation device; and a layer of thermal grease being sandwiched between the hot side of the thermoelectric cooler and the bottom surface of the base for enhancing heat transfer efficiency therebetween.

2. The light source module as claimed in claim 1, wherein the fins extend upwardly from a top surface of the base.

3. The light source module as claimed in claim 2, wherein the bottom surface of the base has a shape and size corresponding to a top surface of the hot side.

4. The light source module as claimed in claim 2, wherein the heat dissipation device comprises at least one heat pipe.

5. The light source module as claimed in claim 4, wherein one end of the at least one heat pipe is attached to one of the top surface of the base and the hot side of the thermoelectric cooler, and another end of the at least one end of the heat pipe is connected to the fins.

6. The light source module as claimed in claim 1, wherein the LED module further comprises a printed circuit board attached to the cold side of the thermoelectric cooler, the LEDs are mounted on the printed circuit board.

7. A light source module, comprising:

an LED module comprising a printed circuit board and a plurality of LEDs electrically connected to the printed circuit board;

a heat dissipation device comprising a base, a plurality of fins located on a top side of the base, and a fan attached to a lateral side of the fins for generating an airflow, the fan having an outlet opening facing channels between the fins, the airflow provided by the fan flowing through the fins so that heat of the heat dissipation device can be dissipated quickly;

a thermoelectric cooler having a cold side and a hot side, the cold side thermally contacting with the printed circuit board of the LED module, and the hot side thermally contacting with a bottom surface of the base of the heat dissipation device; and a layer made of heat conductive material being sandwiched between the hot side of the thermoelectric cooler and the bottom surface of the base, the heat conductive material being chosen from a group consisting of metal and thermal grease.

8. A light source module, comprising:

an LED module comprising a plurality of LEDs;

a heat dissipation device comprising a base, a plurality of fins extending upwardly from a top surface of the base and a fan arranged at a lateral side of the fins for generating an airflow, the fan having an outlet opening facing the fins so that the airflow generated by the fan is driven to flow through the fins;

a thermoelectric cooler having a cold side and a hot side, the cold side being in thermal engagement with the light emitting diodes, and the hot side being in thermal engagement with a bottom surface of the base of the heat dissipation device; and a layer of metal being sandwiched between the hot side of the thermoelectric cooler and the bottom surface of the base for enhancing heat transfer efficiency therebetween.

9. The light source module as claimed in claim 8, wherein the heat dissipation device further comprises a heat pipe, one end of the heat pipe being attached to the top surface of the base and the hot side of the thermoelectric cooler directly, and the other end of the heat pipe extending through the fins.

* * * * *